US009016006B2

(12) United States Patent
Kumar

(10) Patent No.: US 9,016,006 B2
(45) Date of Patent: Apr. 28, 2015

(54) FABRICATED STONE APPARATUS AND METHOD OF CONSTRUCTING THE SAME

(71) Applicant: Ajit Kumar, Windham, NH (US)

(72) Inventor: Ajit Kumar, Windham, NH (US)

( * ) Notice: Subject to any disclaimer, the term of this patent is extended or adjusted under 35 U.S.C. 154(b) by 0 days.

(21) Appl. No.: 13/921,332

(22) Filed: Jun. 19, 2013

(65) Prior Publication Data

US 2013/0333308 A1 Dec. 19, 2013

Related U.S. Application Data

(60) Provisional application No. 61/661,397, filed on Jun. 19, 2012.

(51) Int. Cl.
*E02D 5/74* (2006.01)
*E04B 1/04* (2006.01)

(52) U.S. Cl.
CPC ..... *E04B 1/04* (2013.01)

(58) Field of Classification Search
USPC ..... 52/155, 834, 835, 315; 232/45, 47
See application file for complete search history.

(56) References Cited

U.S. PATENT DOCUMENTS 4,409,764 A * 10/1983 Wilnau ..... 52/127.3
4,422,269 A 12/1983 Giard
5,361,977 A 11/1994 Ogrodnick, Jr.
5,551,662 A 9/1996 Keady
5,673,512 A 10/1997 Dupre
5,836,572 A 11/1998 Sugiyama
5,934,035 A 8/1999 Rasmussen et al.
6,185,888 B1 2/2001 Wasson
6,763,640 B2 7/2004 Lane
7,073,298 B1 * 7/2006 Phan ..... 52/223.7
7,080,827 B1 7/2006 McCannon, Jr.
7,163,140 B1 1/2007 Kaiser
2004/0244329 A1 12/2004 Delantar, Jr.
2007/0044413 A1 * 3/2007 Gossett, III ..... 52/596
2007/0254133 A1 11/2007 Montanile et al.
2007/0266662 A1 11/2007 Oram et al.
2011/0030292 A1 2/2011 Oram et al.
2011/0283657 A1 11/2011 Barrett et al.

* cited by examiner

*Primary Examiner* — Jeanette E Chapman
*Assistant Examiner* — Daniel Kenny
(74) *Attorney, Agent, or Firm* — Hayes Soloway PC

(57) ABSTRACT

A fabricated stone apparatus is provided. A plurality of stone sheets are affixed together to form a fabricated stone structure having a substantially hollow interior portion, wherein each of the plurality of stone sheets is substantially planar, and wherein a side edge of one of the plurality of stone sheets engages with a side edge of another of the plurality of stone sheets. A cover plate is positioned at an end of the fabricated stone structure, wherein the cover plate is connected to a top edge of at least a portion of the plurality of stone sheets, wherein the top edge is positioned substantially perpendicular to at least one of the side edges. At least one fastener is connected between at least two of the plurality of stone sheets, wherein the at least one fastener is positioned remotely from the cover plate.

9 Claims, 15 Drawing Sheets

FABRICATED STONE APPARATUS AND METHOD OF CONSTRUCTING THE SAME

CROSS REFERENCE TO RELATED APPLICATION

This application claims benefit of U.S. Provisional Application Ser. No. 61/661,397 entitled, "Fabricated Stone Structure and Method of Constructing the Same" filed Jun. 19, 2012, the entire disclosure of which is incorporated herein by reference.

FIELD OF THE DISCLOSURE

The present disclosure is generally related to stone structures and more particularly is related to a fabricated stone apparatus and method of constructing the same.

BACKGROUND OF THE DISCLOSURE

Solid stone structures, such as stone posts and stone slabs are highly sought after as building materials in a living space or work space. For example, granite posts may be desired to be used as mailbox posts or lamp posts by people seeking a long-lasting, high-quality look for the exterior of their living space, such as a drive way or yard, or work space, such as with columns of a building. Solid stone structures not only provide durability with whatever they may support, but they are also aesthetically pleasing, and thus highly desired.

However, the use of solid stone structures does have some drawbacks, including the cost of a solid stone structure, the inconvenience of installing the solid stone structure, and the inability of the solid stone structure to perform functions beyond supporting another article. The costs of solid stone structures are usually very high, due to the fact that solid stone structures are derived from relatively large pieces of stone, which are harder to find and harder to process into a finished product. In contrast, smaller stone materials may be relatively inexpensive, since they can be derived from the offcuts and manufacturing byproducts of processing large stones. Even the smallest solid stone posts and pillars may weigh hundreds of pounds. They can be very difficult to install since they may require a team of workers and a large footing to secure them in, such as a large hole or a concrete base. Often, heavy machinery is needed to lift the solid stone structure into an installation position.

Another drawback of solid stone structures is that it can be difficult to install fixtures and other items to them. While some solid stone posts have small holes bored through them for carrying an electrical line to a light affixed to the top of the post, it can be very difficult to bore a hole, since it requires drilling through solid stone. Furthermore, it is impossible to bore center holes with non-arced outer surfaces, such as 90° angles. While bracketry is available within the art to mount some fixtures to solid stone posts, the bracketry is generally limited to threaded fasteners which are affixed within the outermost layer of the stone post and often can inadvertently release.

Thus, a heretofore unaddressed need exists in the industry to address the aforementioned deficiencies and inadequacies.

SUMMARY OF THE DISCLOSURE

Embodiments of the present disclosure provide a system and method for a fabricated stone apparatus. Briefly described, in architecture, one embodiment of the system, among others, can be implemented as follows. The fabricated stone apparatus comprises a plurality of stone sheets affixed together to form a fabricated stone structure having a substantially hollow interior portion, wherein each of the plurality of stone sheets is substantially planar, and wherein a side edge of one of the plurality of stone sheets engages with a side edge of another of the plurality of stone sheets. A cover plate is positioned at an end of the fabricated stone structure, wherein the cover plate is connected to a top edge of at least a portion of the plurality of stone sheets, wherein the top edge is positioned substantially perpendicular to at least one of the side edges. At least one fastener is connected between at least two of the plurality of stone sheets, wherein the at least one fastener is positioned remotely from the cover plate.

The present disclosure can also be viewed as providing a fixture-supporting, fabricated stone post apparatus. Briefly described, in architecture, one embodiment of the apparatus, among others, can be implemented as follows. A plurality of stone sheets is affixed together to form a fabricated stone structure having a substantially hollow interior portion, wherein each of the plurality of stone sheets is substantially planar, and wherein a side edge of one of the plurality of stone sheets engages with a side edge of another of the plurality of stone sheets, wherein a lower end of the fabricated stone structure is positioned below a ground surface. A cover plate is positioned at an upper end of the fabricated stone structure, wherein the cover plate is connected to a top edge of at least a portion of the plurality of stone sheets, wherein the top edge is positioned substantially perpendicular to at least one of the side edges. At least one fastener is connected between at least two opposing stone sheets, wherein the at least one fastener is located in a position below the ground surface.

The present disclosure can also be viewed as providing methods of manufacturing a fabricated stone apparatus. In this regard, one embodiment of such a method, among others, can be broadly summarized by the following steps: engaging at least three stone sheets by connecting a side edge of each of one of the at least three stone sheets with a side edge of another of each of the at least three stone sheets, thereby forming a fabricated stone structure having a substantially hollow interior portion, wherein each of the at least three stone sheets is substantially planar; connecting a cover plate to a top edge of at least a portion of the at least three stone sheets, wherein the top edge is substantially perpendicular to the side edge; and fastening at least two of the at least three stone sheets together with at least one fastener, wherein the at least one fastener is positioned remotely from the cover plate.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
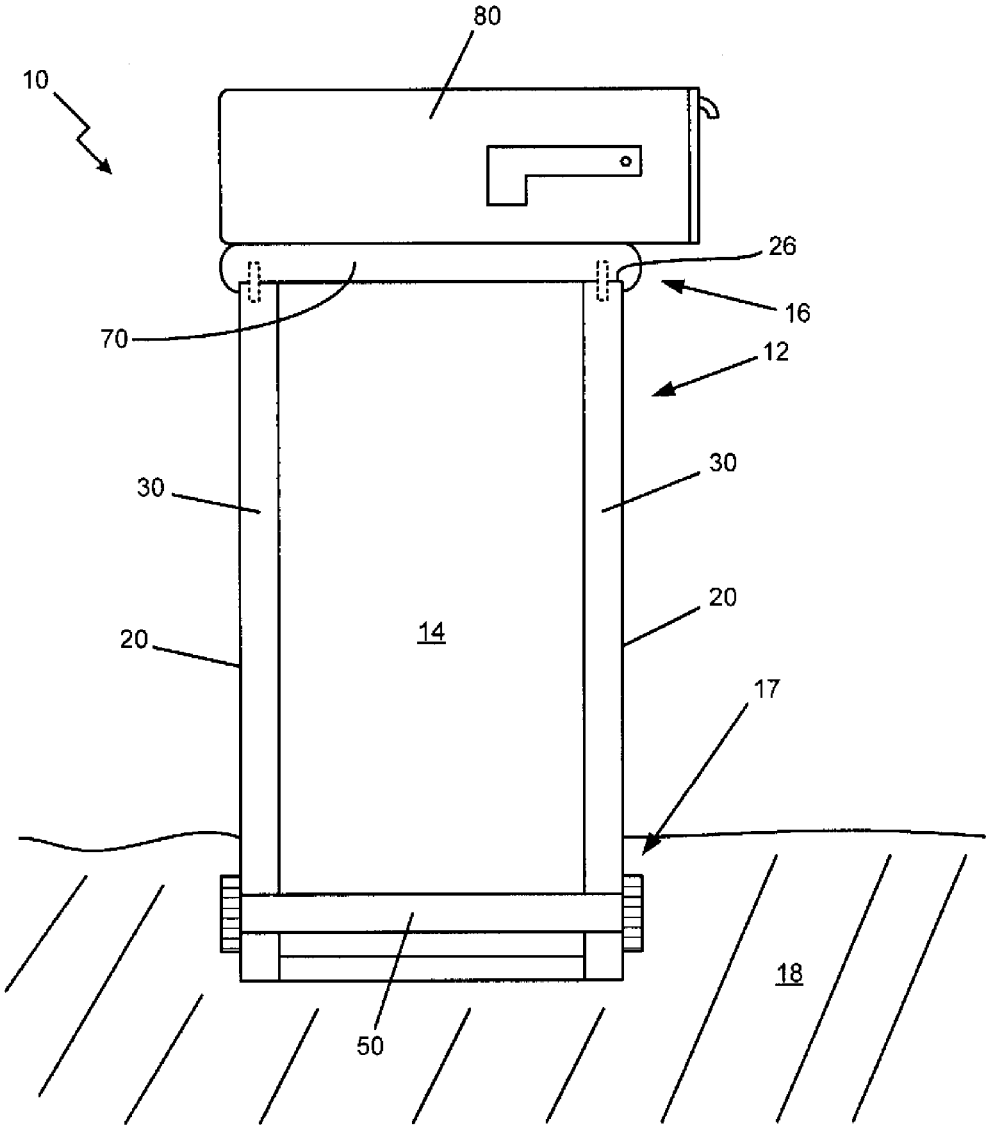
FIG. 1 is a cross-sectional illustration of a fabricated stone apparatus, in accordance with a first exemplary embodiment of the present disclosure.

FIG. 1 is a cross-sectional illustration of a fabricated stone apparatus 10, in accordance with a first exemplary embodiment of the present disclosure. The fabricated stone apparatus 10, which may be referred to simply as 'apparatus 10' includes a plurality of stone sheets 20 affixed together to form a fabricated stone structure 12 having a substantially hollow interior portion 14, wherein each of the plurality of stone sheets 20 is substantially planar, and wherein a side edge 30 on one of the plurality of stone sheets 20 engages with a side edge 32 (FIG. 2) on another of the plurality of stone sheets 20. A cover plate 70 positioned at an end 16 of the fabricated stone structure 12, wherein the cover plate 70 is connected to a top edge 26 of at least a portion of the plurality of stone sheets 20, wherein the top edge 26 is positioned substantially perpendicular to at least one of the side edges 30. At least one fastener 50 connected between at least two of the plurality of stone sheets 20, wherein the at least one fastener 50 is positioned remotely from the cover plate 70.

The apparatus 10 may be used in replacement of various structures, especially stone structures that are used for holding or supporting fixtures. Conventional stone posts are solid, unitary structures that are employed as lamp posts, fence posts, stone blocks, stone walls, interior or exterior pillars, columns, vertical and/or horizontally oriented slabs, as well as other structures commonly constructed from solid stone materials. Conventional structures formed from solid stone materials are extremely heavy due to the mass of the stone materials. For example, a single granite lamp post may weigh hundreds of pounds, which makes it difficult to transport and install. Solid stone posts can also be very expensive, since they must be cut or formed from large blocks of stone. The apparatus 10 may be a replacement for solid stone structures and may provide many benefits over them, while at the same time providing an aesthetically pleasing, durable stone structure that can be used in a variety of ways.

While use of the apparatus 10 may vary, one common use is as a post or support for a fixture. For example, as is shown in FIG. 1, the apparatus 10 may support a fixture 80 either on top of the cover plate 70 or affixed to one or more of the stone sheets 20. The fixtures 80 or structures that the apparatus 10 may support include mail boxes, lamps, lighting fixtures, signs, fencing materials, entryways, electronic devices such as cameras, security equipment, among many others. The apparatus 10 may also be used without supporting another device, such as when the apparatus 10 is used to form a wall or barrier. It is noted that when the apparatus 10 is used for a specific purpose, such as for supporting a mail box, it may be configured to meet the any regulations or requirements, such as height or size requirements of a mail box by the U.S. Postal Service.

Each of the plurality of stone sheets 20 is a substantially planar structure that has parallel sides. A substantially planar structure may be characterized as a structure that has length and width dimensions that exceed, usually by a great degree, a thickness dimension. The plurality of stone sheets 20 may have any length and width dimensions, and may also have any thickness dimension, although it may be common for the thickness of the plurality of stone sheets 20 to be less than one and a half inch, and more preferably less than or equal to a ⅝ inch. The stone sheets 20 may be smooth, textured, or any combination thereof. In some fields, the stone sheets 20 may be referred to as laminated stone structures. Any number of stone sheets 20 may be affixed together to form the fabricated stone structure 12. In accordance with this disclosure, the apparatus 10 may utilize any type of stone, including but not limited to granite, marble, slate, as well as stone composite materials, such as ceramics, synthetic stone materials, or other natural or artificial stone material. In some cases, the structure and method disclosed herein may have uses for non-stone materials, including wood, plastics, or metals.

The plurality of stone sheets 20 are connected together to form the fabricated stone structure 12, which is characterized as a structure formed from engagement of at least three stone sheets 20. The fabricated stone structure 12 has a substantially hollow interior portion 14 which is positioned interior of the stone sheets 20 and the cover plate 70. Depending on the use of the apparatus 10, the substantially hollow interior portion 14 may be fully hollow, partially hollow, or used to house another component of the apparatus 10. For example, a variety of supporting equipment may be used with the apparatus 10, such as wiring or plumbing that is positioned through the hollow interior portion 14 to provide a utility, such as electrical power, water, or light, to a fixture 80. Additionally, a supporting member or liner, such as a conduit, may be positioned within the hollow interior portion 14. Furthermore, as is discussed relative to FIG. 6B, a portion of the hollow interior portion 14 may be filled with particulate fill, such as dirt, sand, or cement or cement mix, to help anchor or support the apparatus 10 in a substantially vertical position.

The cover plate 70 is positioned at an end 16 of the fabricated stone structure 12 and is connected to a top edge 26 of at least one of the plurality of stone sheets 20, but commonly two or more of the stone sheets 20. The cover plate 70, which may also be a skirt cover plate (not shown), may be used to cap the end 16 of the fabricated stone structure 12, thereby enclosing the interior portion 14 and providing a platform for the fixture 80 or for aesthetic purposes. The cover plate 70 may be connected to the fabricated stone apparatus 12 with a variety of structures, such as threaded fasteners or slot and pin systems, as is discussed with respect to the figures within this disclosure. The cover plate 70 may be formed from stone or a stone material similar to that of the stone sheets 20, or it may be formed from a non-stone material, such as wood, plastic, or metal. For example, it may be desirable for the cover plate 70 to be formed from the same material as the stone sheets 20, thereby creating the visual appearance of a solid post. The cover plate 70 may be smooth, textured, or any combination thereof, and may have any type of edging, such as rounded edges or chamfering. Additionally, the cover plate 70 may have any features necessary for mounting or operating a fixture 80, including holes, fasteners, inset features, and the like.

The fabricated stone structure 12 may be held together with one or a plurality of fasteners 50. The fastener 50 may include any number or combination of adhesive fasteners, non-adhesive fasteners, and mechanical fasteners, such as nuts and bolts, threaded screws, and clamps fasteners. The fastener 50 is connected between at least two of the plurality of stone sheets 20 in a location remote from the cover plate 70. For example, the fastener 50 is positioned separately from the cover plate 70 such that fastens together the plurality of stone sheets 20 without use of any part of the cover plate 70. Generally, the cover plate 70 is located at one end 16 of the fabricated stone structure 12 and the fastener 50 may be located at an opposing end 17 of the fabricated stone structure 12, a middle portion of the fabricated stone structure 12, or a location proximate to the end 16 of the fabricated stone structure 12, but below the cover plate 70. The fastener 50 may be connected between various stone sheets 20, including between abutting stone sheets 20, between non-abutting stone sheets 20, and/or between non-abutting stone sheets 20 where the fastener 50 does not connect abutting stone sheets 20.

One benefit of the apparatus 10 is that it may be easy to construct a final stone product from the components of the apparatus 10. Conventional stone posts are very heavy and hard to install, often requiring a team of workers. In contrast, the apparatus 10 may be assembled by a single user in any location without the need for equipment or machinery commonly needed to install conventional stone structures. For example, the components of the apparatus 10 may be sold as a kit that is assembled by the end user. In this example, the user may engage the stone sheets 20 together to form the fabricated stone structure 12, and use the fastener 50 to retain the fabricated stone structure 12 in an assembled configuration. The assembled fabricated stone structure 12 may then be installed in the desired location, and then the user may install the cover plate 70 and any other devices or components to the apparatus 10. Of course, the apparatus 10 may be installed, built, or otherwise handled in any order, such as with installing the cover plate 70 prior to installation.

The apparatus 10 may be utilized within a variety of different scenarios. For example, as is shown in FIG. 1, the apparatus 10 may be partially buried in the ground 18 to retain the apparatus 10 in a substantially stationary position. In other examples, the apparatus 10 may lie on top of the ground 18, or on top of another surface, such as floors, patios, or building structures. When the apparatus 10 is buried partially in the ground 18, it may be desirable for the fastener 50 to be connected to at least two of the plurality of stone sheets 20 at a proximate end 17 of the fabricated stone structure 12, such that it may be hidden below the surface of the ground 18 after the apparatus 10 is fully installed. Other examples of the apparatus 10 may utilize different fasteners 50 which can be installed in different ways, such that the fastener 50 is eventually hidden from sight or otherwise concealed. Alternatively, fasteners 50 may be placed above ground and hidden from sight by a surrounding skirt cover fabricated of any stone or non-stone materials. Once fully assembled and installed, the joints between the components of the apparatus 10 may have precise connections, such that the apparatus 10 may be visually indistinguishable from a conventional solid stone structure. In another scenario apparatus 10 may be used as cladding to surround an existing post made of metal or any other material to give appearance of a polished stone structure or to transform the appearance of a non-stone post to a stone structure.

Figure 2:
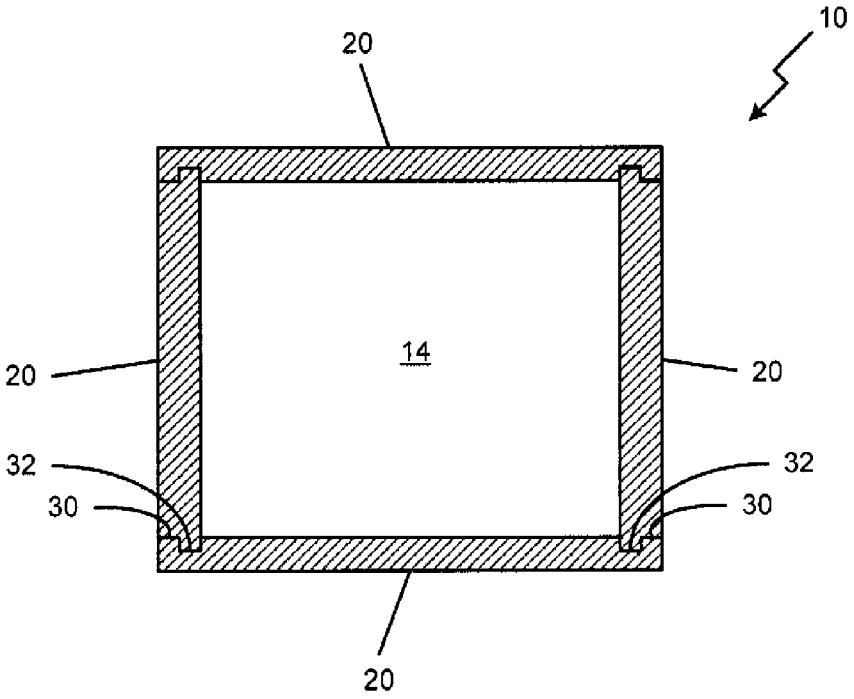
FIG. 2 is a cross-sectional top view illustration of the apparatus, in accordance with the first exemplary embodiment of the present disclosure.

FIG. 2 is a cross-sectional top view illustration of the apparatus 10, in accordance with the first exemplary embodiment of the present disclosure. For clarity in disclosure, the apparatus 10 of FIG. 2 does not depict the fastener 50 or the cover plate 70. The engagement between the side edges 30, 32 of the stone sheets 20 may include many variations. For example, as is shown in FIG. 2, the side edge 30 on one of the stone sheets 20 engages with a side edge 32 on another of the stone sheets 20 to form square edges on the apparatus 10. Of course, the square edges may be chamfered, rounded, or otherwise manipulated depending on the chosen design.

The plurality of stone sheets 20 may be engaged together in a variety of ways, such as with interlocking structures, engaging structures, tongue-and-groove structures, grooved engagements, and/or slots that are formed on the edges of the stone sheets 20. For example, as is shown in FIG. 2, the engagement between the side edges 30, 32 may be a tongue-and-groove engagement, or any other type of engagement depending on the design of the apparatus 10. For example, the engagement may be one where the side edges 30, 32 lock together tightly or loosely. One of the bases of the engagement between the side edges 30, 32 is the aesthetic properties of the apparatus 10. For example, the engagement may be formed in such a way that the connection between the side edges 30, 32 is tight, such that someone viewing the apparatus 10 is unable to visually or somatically distinguish between the stone sheets 20. In other examples, the engagement may be such that there is a visual or textural difference between the stone sheets 20, i.e., such as when the stone sheets 20 are formed from different stone materials or different colored or textured stone materials.

Figure 3:
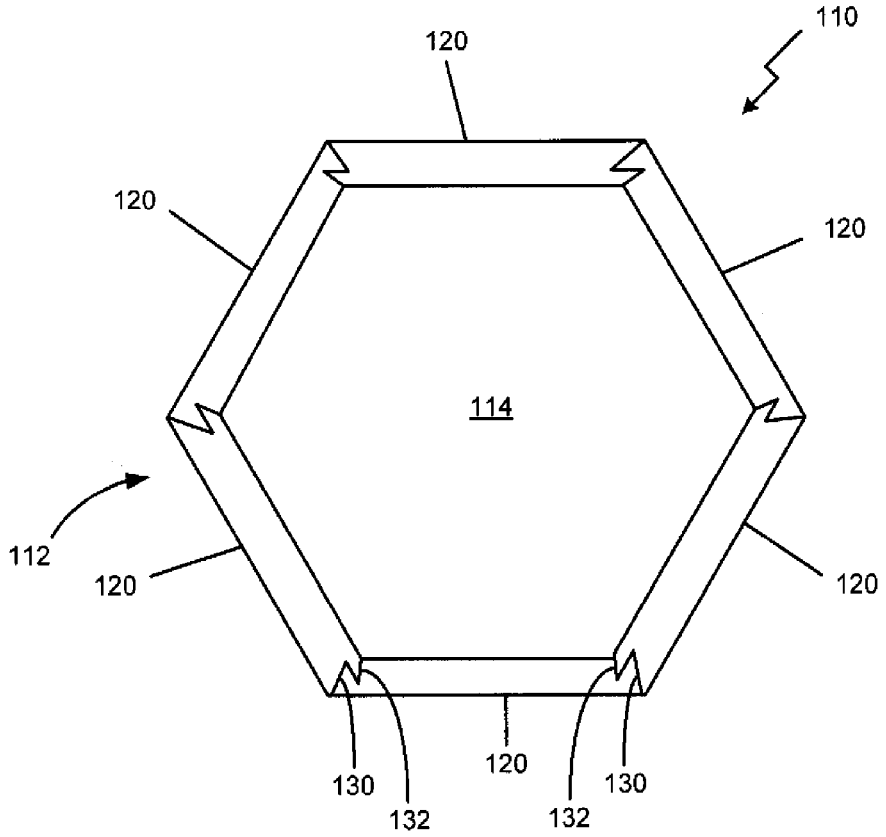
FIG. 3 is a cross-sectional top view illustration of the apparatus, in accordance with a second exemplary embodiment of the present disclosure.

FIG. 3 is a cross-sectional top view illustration of the apparatus 110, in accordance with a second exemplary embodiment of the present disclosure. The second exemplary embodiment of the disclosure may include any of the structures, components, features, or functions disclosed with respect to any of the other embodiments of this disclosure. The apparatus 110 of FIG. 3 includes the features and components shown in FIGS. 1-2 but with the addition of a hexagonal construction of the fabricated stone structure 112. For clarity in disclosure, the apparatus 110 of FIG. 3 does not depict the fastener or the cover plate. Here, the apparatus 110 is formed with six stone sheets 120, each of which is engaged with a side edge 130, 132 with another stone sheet 120. As is shown, the side edges 130, 132 may have a design that is configured for the number of stone sheets 120 used. When assembling the apparatus 110, a user may connect the side edges 130, 132 of each of the stone sheets 120 together. When more than four stone sheets 120 are used, assembly of the apparatus 110 may include a combination of engaging the first and second edges 130, 132 by pushing them together or sliding one with respect to the other, i.e., such as connecting together five of the stone sheets 120 and then sliding the sixth stone sheet 120 in to complete the fabricated stone structure 112.

Figure 4:
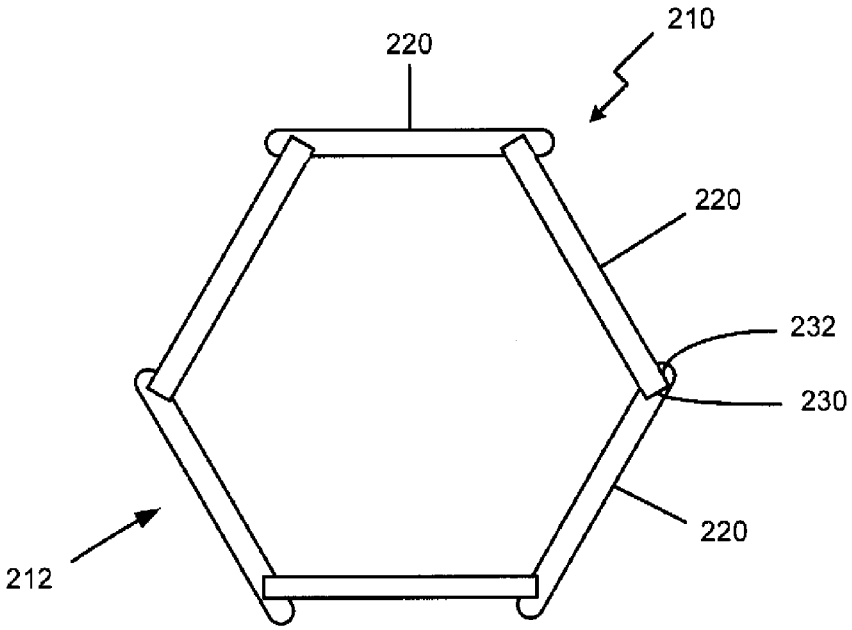
FIG. 4 is a cross-sectional top view illustration of the apparatus, in accordance with a third exemplary embodiment of the present disclosure.
Figure 5:
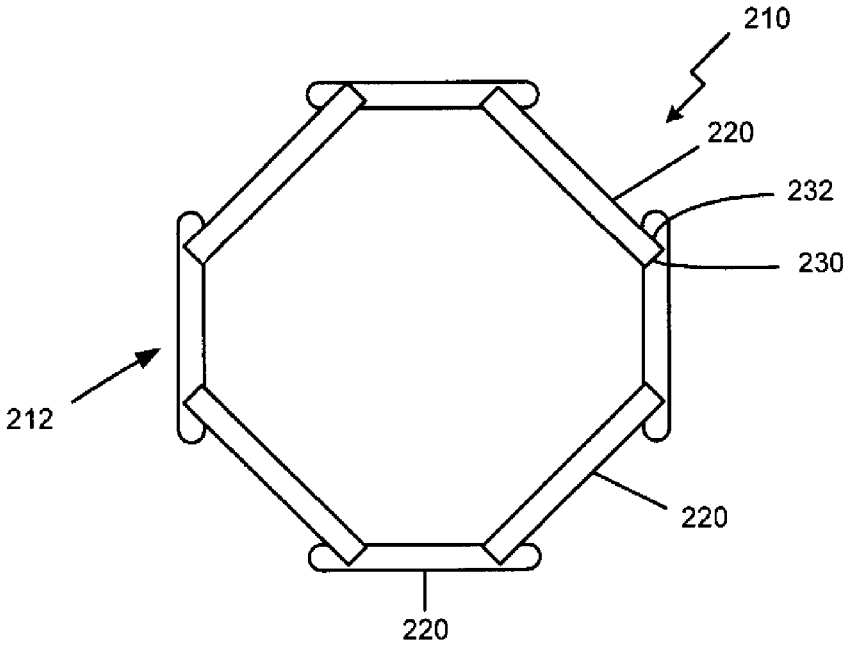
FIG. 5 is a cross-sectional top view illustration of the apparatus, in accordance with the third exemplary embodiment of the present disclosure.

FIG. 4 is a cross-sectional top view illustration of the apparatus 210, in accordance with a third exemplary embodiment of the present disclosure and FIG. 5 is a cross-sectional top view illustration of the apparatus 210, in accordance with the third exemplary embodiment of the present disclosure. The third exemplary embodiment of the disclosure may include any of the structures, components, features, or functions disclosed with respect to any of the other embodiments of this disclosure. The apparatus 210 of FIGS. 4-5 includes the features and components shown in FIGS. 1-2 but with the addition of a hexagonal construction of the fabricated stone structure 212 in FIG. 4, or octagonal construction of the fabricated stone structure 212 in FIG. 5. For clarity in disclosure, the apparatus 210 of FIGS. 4-5 does not depict the fastener or the cover plate. FIG. 4 depicts the apparatus 210 in a hexagonal design using six stone sheets 220, whereas FIG. 5 depicts the apparatus 210 in an octagonal design using eight stone sheets 220. In FIGS. 4-5, the apparatus 210 is shown with a round edge design, such that the engagements of the side edges 230, 232 include non-flush surfaces. When the round-edge design is used, the apparatus 210 may still provide engagements between the stone sheets 220 that prevents one from distinguishing between the individual stone sheets 220.

Figure 6A:
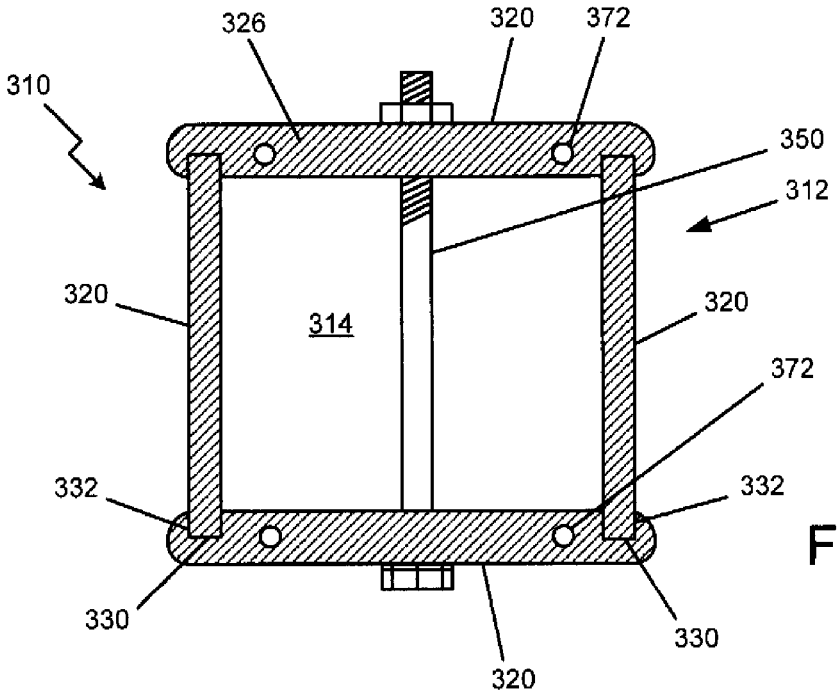
FIG. 6A is a top view illustration of a fabricated stone apparatus without the cover plate, in accordance with a fourth embodiment of the present disclosure.
Figure 6B:
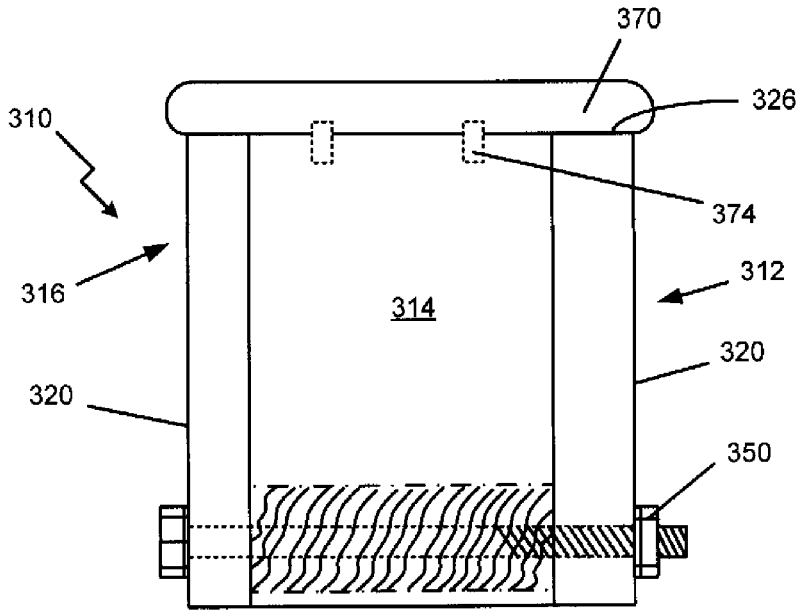
FIG. 6B is a cross-sectional side view of the fabricated stone apparatus, in accordance with the fourth exemplary embodiment of the present disclosure.

FIG. 6A is a top view illustration of a fabricated stone apparatus 310 without the cover plate 370, in accordance with a fourth embodiment of the present disclosure. FIG. 6B is a cross-sectional side view of the fabricated stone apparatus 310, in accordance with the fourth exemplary embodiment of the present disclosure. The fabricated stone apparatus 310 of the fourth exemplary embodiment of the disclosure, which may be referred to herein as 'apparatus 310' may include any of the structures, components, features, or functions disclosed with respect to any of the other embodiments of this disclosure. With reference to FIGS. 6A-6B, the apparatus 310 includes a plurality of stone sheets 320 affixed together to form a fabricated stone structure 312 having a substantially hollow interior portion 314, wherein each of the plurality of stone sheets 320 is substantially planar, and wherein a side edge 330 on one of the plurality of stone sheets 320 engages with a side edge 332 on another of the plurality of stone sheets 320. A cover plate 370 positioned at an end 316 of the fabricated stone structure 312, wherein the cover plate 370 is connected to a top edge 326 of at least a portion of the plurality of stone sheets 320, wherein the top edge 326 is positioned substantially perpendicular to at least one of the side edges 330. At least one fastener 350 connected between at least two of the plurality of stone sheets 320, wherein the at least one fastener 350 is positioned remotely from the cover plate 370.

As is shown, the apparatus 310 is depicted with the round-edge design with the fastener 350 connected between two of the stone sheets 320 and the side edges 330, 332 of the stone sheets 320 engaged together. In FIG. 6A, at the top edge 326 of some of the stone sheets 320 may be a slot 372 for receiving a pin 374. The pin 374, shown in FIG. 6B, may be used to connect the cover plate 370 to the stone sheets 320. For example, once the stone sheets 320 are engaged or fastened together, the pin 374 may be placed within a slot 372 in the stone sheets 320. The cover plate 370 is then positioned on the stone sheets 320 such that the pin 374 engages with a slot in the cover plate 370, thereby joining the cover plate 370 to the stone sheets 320.

Figure 7A:
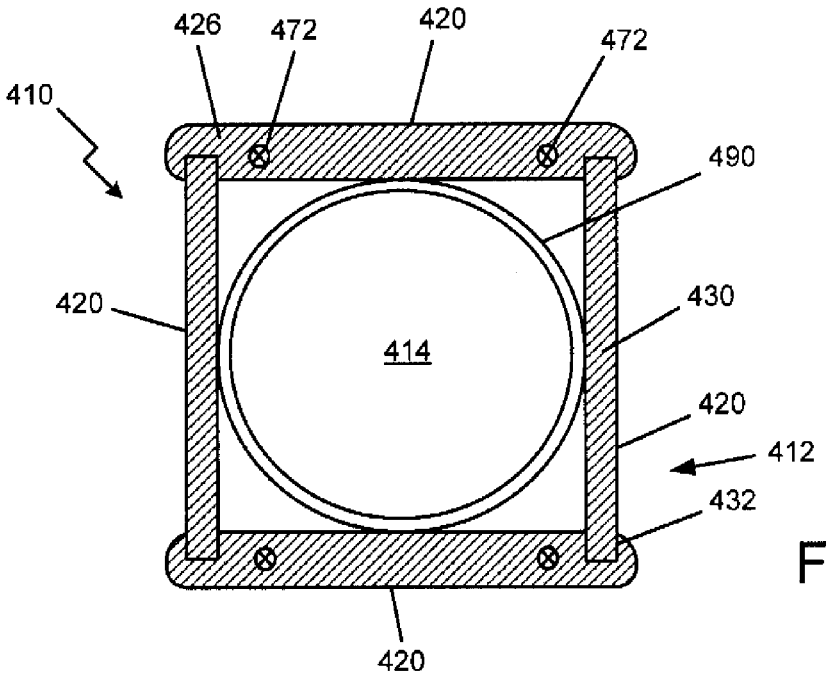
FIG. 7A is a top view illustration of a fabricated stone apparatus without the cover plate, in accordance with a fifth exemplary embodiment of the present disclosure.
Figure 7B:
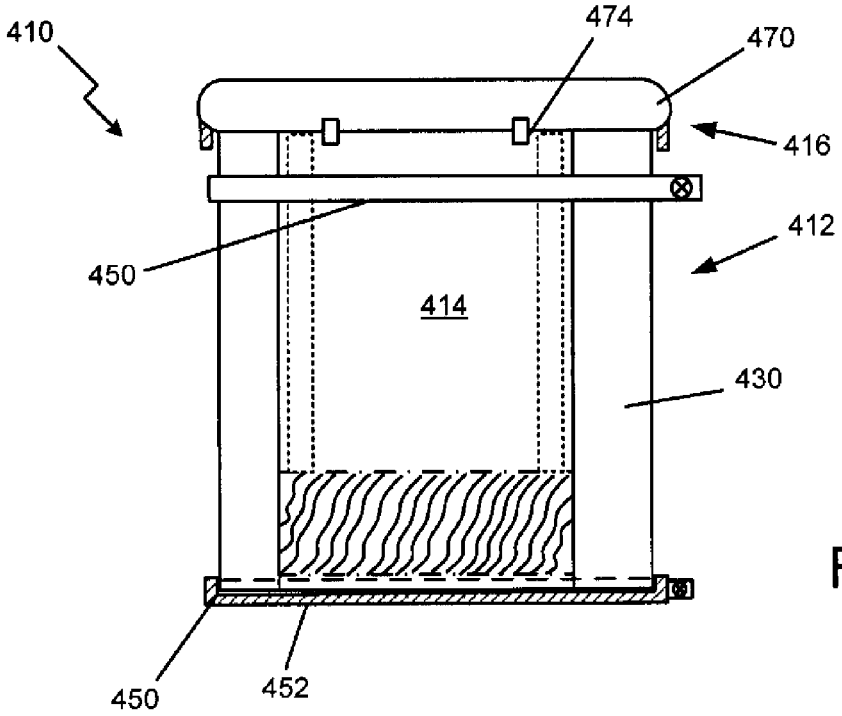
FIG. 7B is a cross-sectional side view of the fabricated stone apparatus, in accordance with the fifth exemplary embodiment of the present disclosure.

FIG. 7A is a top view illustration of a fabricated stone apparatus 410 without the cover plate 470, and FIG. 7B is a cross-sectional side view of the fabricated stone apparatus 410, in accordance with the fifth exemplary embodiment of the present disclosure. The fabricated stone apparatus 410 of the fifth exemplary embodiment of the disclosure, which may be referred to herein as 'apparatus 410' may include any of the structures, components, features, or functions disclosed with respect to any of the other embodiments of this disclosure. With reference to FIGS. 7A-7B, the apparatus 410 includes a plurality of stone sheets 420 affixed together to form a fabricated stone structure 412 having a substantially hollow interior portion 414, wherein each of the plurality of stone sheets 420 is substantially planar, and wherein a side edge 430 on one of the plurality of stone sheets 420 engages with a side edge 432 on another of the plurality of stone sheets 420. A cover plate 470 positioned at an end 416 of the fabricated stone structure 412, wherein the cover plate 470 is connected to a top edge 426 of at least a portion of the plurality of stone sheets 420, wherein the top edge 426 is positioned substantially perpendicular to at least one of the side edges 430. At least one fastener 450 connected between at least two of the plurality of stone sheets 420, wherein the at least one fastener 450 is positioned remotely from the cover plate 470.

As is shown in FIG. 7B, the apparatus 410 is depicted with the round-edge design with the fastener 450 connected around the fabricated stone structure 412 as a clamp. The clamp fastener 450 may be positioned about the exterior circumference of the fabricated stone structure 412 to encircle it, and then tightened accordingly. In this fashion, the clamp fastener 450 may retain the edges of the stone sheets 420 engaged together. A plurality of fasteners 450 may be used, wherein one is positioned proximate to the top edge 426 and another is positioned remote from the top edge 426. For example, the clamp fastener 450 may also be used at the base of the apparatus 412, and it may have holes 452 formed therein for allowing the egress of moisture or other substances, or for allowing utility structures to enter the interior portion 414 of the apparatus 410.

Similar to FIG. 6A, at the top of some of the stone sheets 420 may be a slot 472 for receiving a pin 474 or for receiving a screw or plug. The slot 472 may be aligned with a slot on the cover plate 470 such that the pin 474 can be positioned within the aligned slots 472 or holes. Also shown in FIG. 7A is an insert 490 which may be placed within the fabricated stone structure 412. For example, the insert 490 may be a conduit or tubular pipe for reinforcement or a support column, and may be constructed from a variety of materials including wood, PVC, polyurethane foam, metal, among others.

Figure 8A:
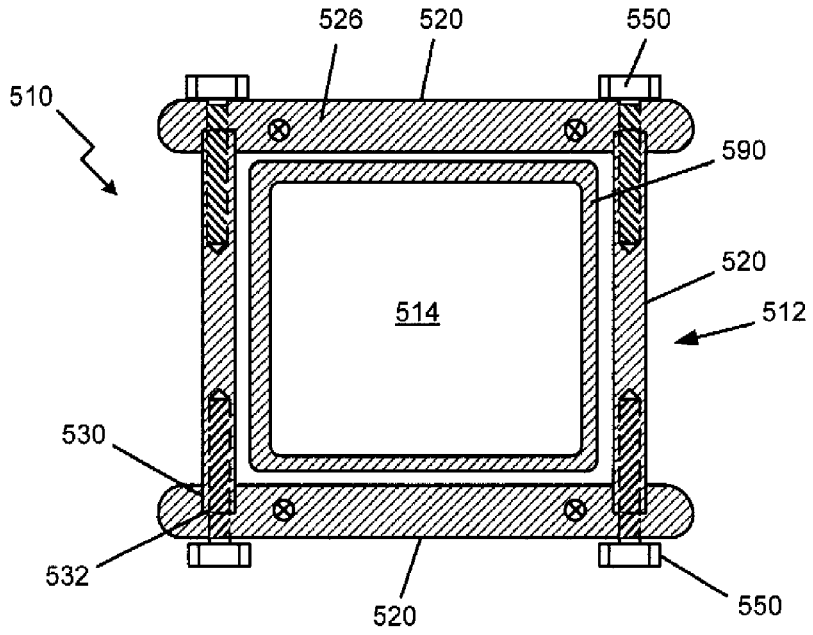
FIG. 8A is a top view illustration of a fabricated stone apparatus without the cover plate, in accordance with a sixth exemplary embodiment of the present disclosure.
Figure 8B:
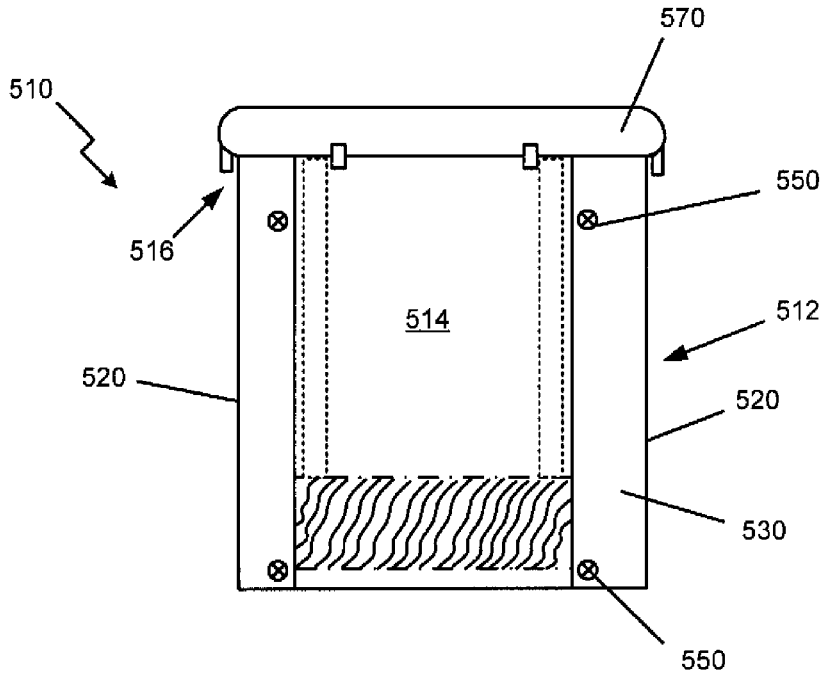
FIG. 8B is a cross-sectional side view of the fabricated stone apparatus, in accordance with the sixth exemplary embodiment of the present disclosure.

FIG. 8A is a top view illustration of a fabricated stone apparatus 510 without the cover plate 570, and FIG. 8B is a cross-sectional side view of the fabricated stone apparatus 510, in accordance with the sixth exemplary embodiment of the present disclosure. The fabricated stone apparatus 510 of the sixth exemplary embodiment of the disclosure, which may be referred to herein as 'apparatus 510' may include any of the structures, components, features, or functions disclosed with respect to any of the other embodiments of this disclosure. With reference to FIGS. 8A-8B, the apparatus 510 includes a plurality of stone sheets 520 affixed together to form a fabricated stone structure 512 having a substantially hollow interior portion 514, wherein each of the plurality of stone sheets 520 is substantially planar, and wherein a side edge 530 on one of the plurality of stone sheets 520 engages with a side edge 532 on another of the plurality of stone sheets 520. A cover plate 570 positioned at an end 516 of the fabricated stone structure 512, wherein the cover plate 570 is connected to a top edge 526 of at least a portion of the plurality of stone sheets 520, wherein the top edge 526 is positioned substantially perpendicular to at least one of the side edges 530. At least one fastener 550 connected between at least two of the plurality of stone sheets 520, wherein the at least one fastener 550 is positioned remotely from the cover plate 570.

As is shown in FIG. 8B, the apparatus 510 is depicted with the round-edge design with the bolt or screw fasteners 550. The bolt or screw fasteners 550 may be used to fasten the stone sheets 520 together. For example, the fastener 550 may be positioned through the planar side of one stone sheet 520 and into the non-planar end of another stone sheet 520. The fastener 550 may be used in conjunction with engagement structures on each of the stone sheets 520, such that both the side edges 530, 532 and the fasteners 550 retain the fabricated stone structure 512 together. Also shown in FIG. 8A is an insert 590 which may be placed within the fabricated stone structure 512. For example, the insert 590 may be a square pipe for reinforcement or a support column, and may be constructed from a variety of materials including wood, PVC, polyurethane foam, metal, among others.

Figure 9:
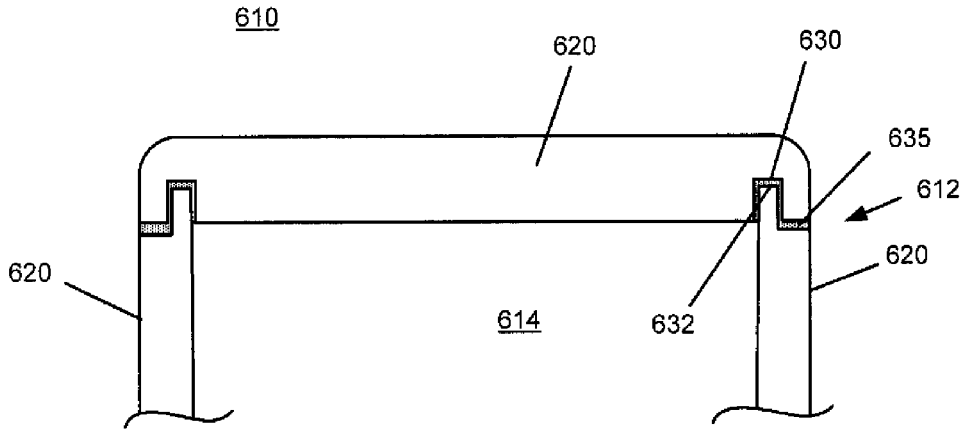
FIG. 9 is a cross-sectional top view illustration of a fabricated stone apparatus, in accordance with a seventh exemplary embodiment of the present disclosure.

FIG. 9 is a cross-sectional top view illustration of a fabricated stone apparatus 610, in accordance with a seventh exemplary embodiment of the present disclosure. The seventh exemplary embodiment of the disclosure may include any of the structures, components, features, or functions disclosed with respect to any of the other embodiments of this disclosure. The fabricated stone apparatus 610, which may be referred to as 'apparatus 610' includes the general structure disclosed in FIG. 1 and the first exemplary embodiment. Specifically, the plurality of stone sheets 620 may be engaged together to form the fabricated stone structure 612 having a hollow interior portion 614. Each of the stone sheets 620 have side edges 630, 632 that engage with side edges 630, 632 of another stone sheet 620. Positioned between the side edges 630, 632, i.e., in the joint formed between the stone sheets 620, is an adhesive filler substance 635. The adhesive filler substance 635 may be formed from adhesive materials and ground or powdered stone material of similar composition as the stone sheet 620 itself. The adhesive filler substance 635 may be used to join the stone sheets 620 together as well as provide an aesthetic filler within the joint formed between the stone sheets 620, such that the stone sheets 620 are visually indistinguishable from one another.

Figure 10:
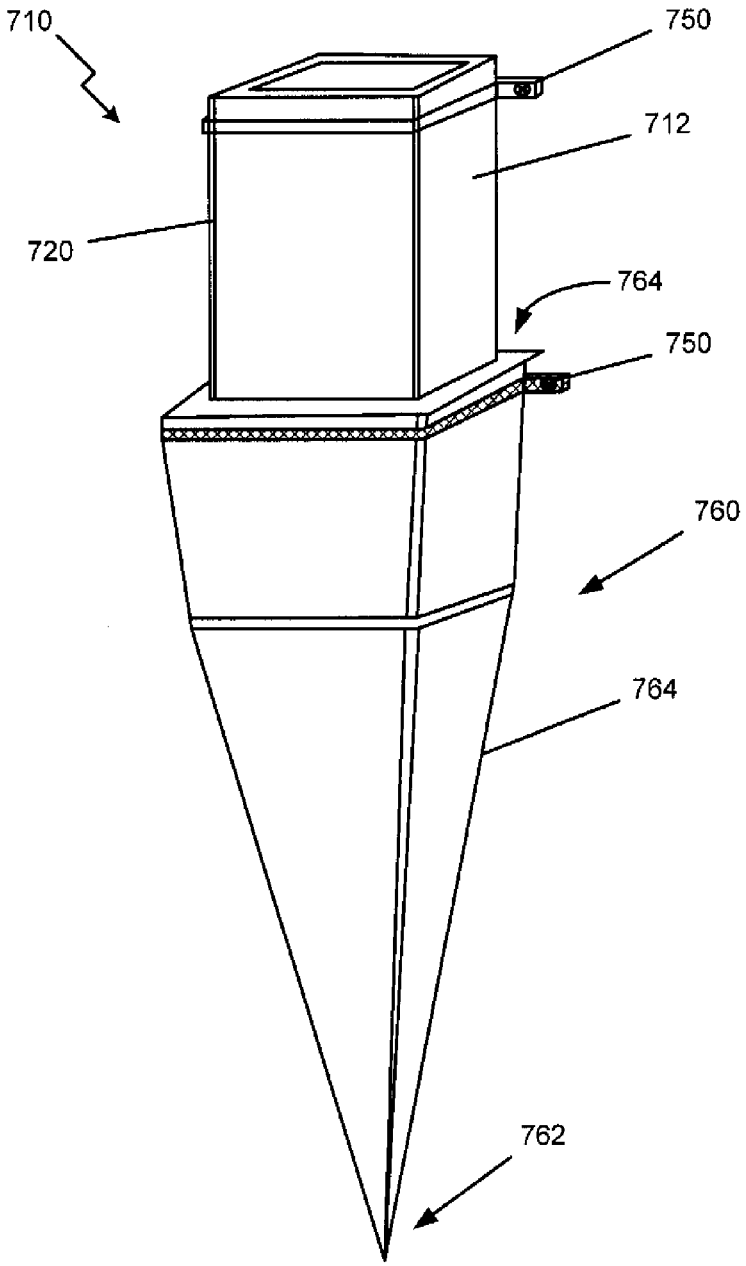
FIG. 10 is a plan view illustration of a spike holder used with a fabricated stone apparatus, in accordance with an eighth exemplary embodiment of the present disclosure.

FIG. 10 is a plan view illustration of a spike holder 760 used with a fabricated stone apparatus 710, in accordance with an eighth exemplary embodiment of the present disclosure. The eighth exemplary embodiment of the disclosure may include any of the structures, components, features, or functions disclosed with respect to any of the other embodiments of this disclosure. The fabricated stone apparatus 710, which may be referred to as 'apparatus 710' may be secured in place with the spike holder 760. The spike holder 760 may have a pointed end 762 that can be driven or forced into the ground and a receiving end 764 that may receive the fabricated stone structure 712. The receiving end 764 may have an opening that is sized to receive any portion of the fabricated stone structure 712 therein. Any number of fastening devices 750, such as clamps (as is shown), may be used to secure the fabricated stone structure 712 within the spike holder 760 in the same fashion as the fastening devices 750 can be used to secure the stone sheets 720 together to form the fabricated stone structure 712, as discussed previously. Alternatively, fastening devices may be placed above ground and hidden from sight by a surrounding skirt cover fabricated of any stone or non-stone materials.

The spike holder 760 may be constructed from any type of material that is durable enough to retain the fabricated stone structure 712 and receive the forces associated with driving the spike holder 760 into the ground. For example, the spike holder 760 may be constructed from metals, hard plastics, or a combination of various materials. The spike holder 760 may include one or more openings therein (not shown) for running a wire, cable, or pipe through the spike holder 760 and into the fabricated stone structure 712.

Figure 11A:
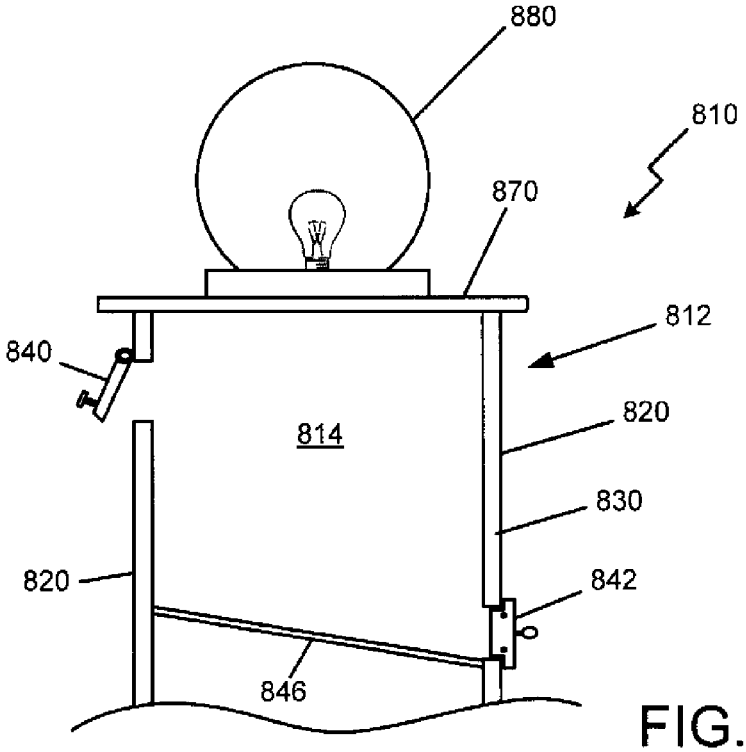
FIG. 11A is a cross-sectional view illustration of a fabricated stone apparatus, in accordance with a ninth exemplary embodiment of the present disclosure.

FIG. 11A is a cross-sectional view illustration of a fabricated stone apparatus 810, in accordance with a ninth exemplary embodiment of the present disclosure. The ninth exemplary embodiment of the disclosure may include any of the structures, components, features, or functions disclosed with respect to any of the other embodiments of this disclosure. The fabricated stone apparatus 810, which may be referred to as 'apparatus 810' includes a plurality of stone sheets 820 affixed together to form a fabricated stone structure 812 having a substantially hollow interior portion 814, wherein each of the plurality of stone sheets 820 is substantially planar, and wherein a side edge 830 on one of the plurality of stone sheets 820 engages with a side edge on another of the plurality of stone sheets 820. A cover plate 870 positioned at an end of the fabricated stone structure 812, wherein the cover plate 870 is connected to a top edge of at least a portion of the plurality of stone sheets 820, wherein the top edge is positioned substantially perpendicular to at least one of the side edges 830. At least one fastener (not shown) is connected between at least two of the plurality of stone sheets 820. A fixture 880 may be mounted to the apparatus 810.

The apparatus 810 may include one or more access doors 840, 842 positioned within one of the plurality of stone sheets 820. The access door 840, 842 may control access to the substantially hollow interior portion 814 of the apparatus 810. As is shown in FIG. 11A, a first access door 840 may be positioned on one side of the apparatus 810 while a second access door 842 may be positioned on the other side, opposite the first access door 840. An interior platform 846 may be positioned within the substantially hollow interior portion 814 and be connected to at least one of the stone sheets 820. The first access door 840 may be used to allow items, such as letters and postal items, to be dropped into the interior portion 814. The letters and postal items may fall to the interior platform 846 and be retrieved by another user with the other access door 842. The interior platform 846 may be angled, allowing the letters and postal items to slide proximate to the other access door 842. The access doors 840, 842 may be hinged or otherwise affixed to the stone sheets 820 and may shut securely to prevent moisture or precipitate from entering the interior portion 814. The access doors 840, 842 may further include locks or security measures such as a switch activating a ring a bell in remote location e.g. a house, to inform the owner of any activity at the apparatus 810.

Figure 11B:
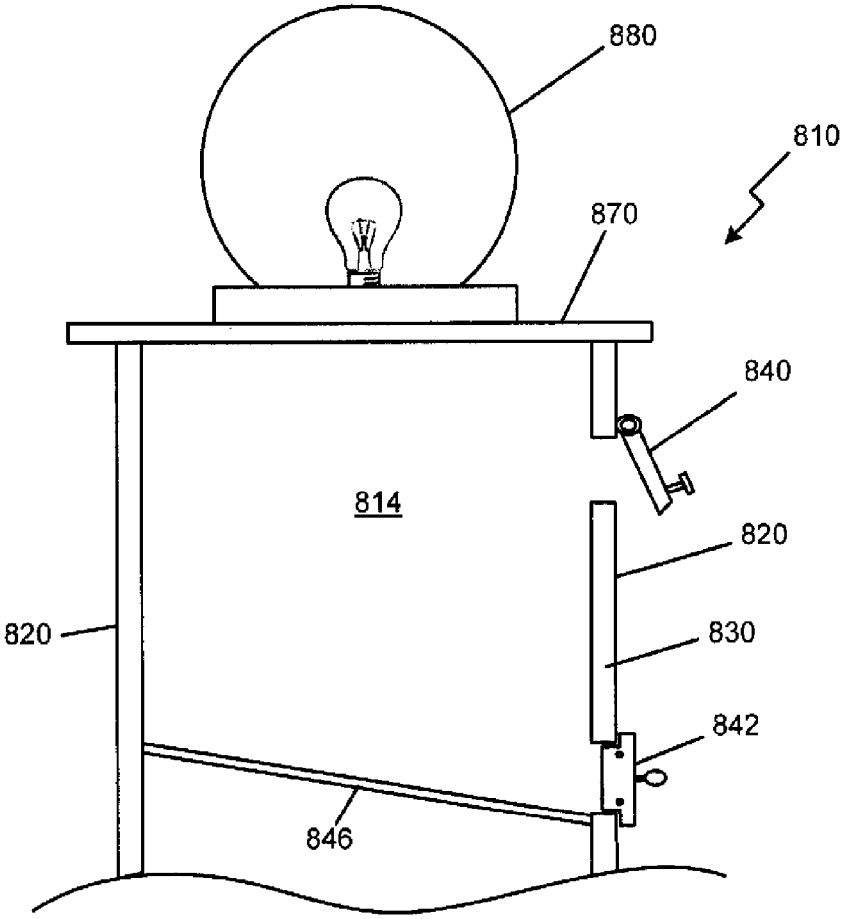
FIG. 11B is a cross-sectional view illustration of a fabricated stone apparatus, in accordance with a ninth exemplary embodiment of the present disclosure.

FIG. 11B is a cross-sectional view illustration of a fabricated stone apparatus 810, in accordance with the ninth exemplary embodiment of the present disclosure. As is shown, a first access door 840 may be positioned on one side of the apparatus 810 with a second access door 842 may be positioned on the same side, but in a different height than the first access door 840. The first or second access doors 840, 442 may be positioned on any side of the apparatus 810 and at any height, of the apparatus 810, all possibilities of which are considered within the scope of this disclosure. An interior platform 846 may be positioned within the substantially hollow interior portion 814 and be connected to at least one of the stone sheets 820. The first access door 840 may be used to allow items, such as letters and postal items, to be dropped into the interior portion 814. The letters and postal items may fall to the interior platform 846 and be retrieved by another user with the other access door 842. The interior platform 846 may be angled, allowing the letters and postal items to slide proximate to the other access door 842. The access doors 840, 842 may be hinged or otherwise affixed to the stone sheets 820 and may shut securely to prevent moisture or precipitate from entering the interior portion 814. The access doors 840, 842 may further include locks or security measures such as a switch activating a ring a bell in remote location e.g. a house, to inform the owner of any activity at the apparatus 810.

Figure 12:
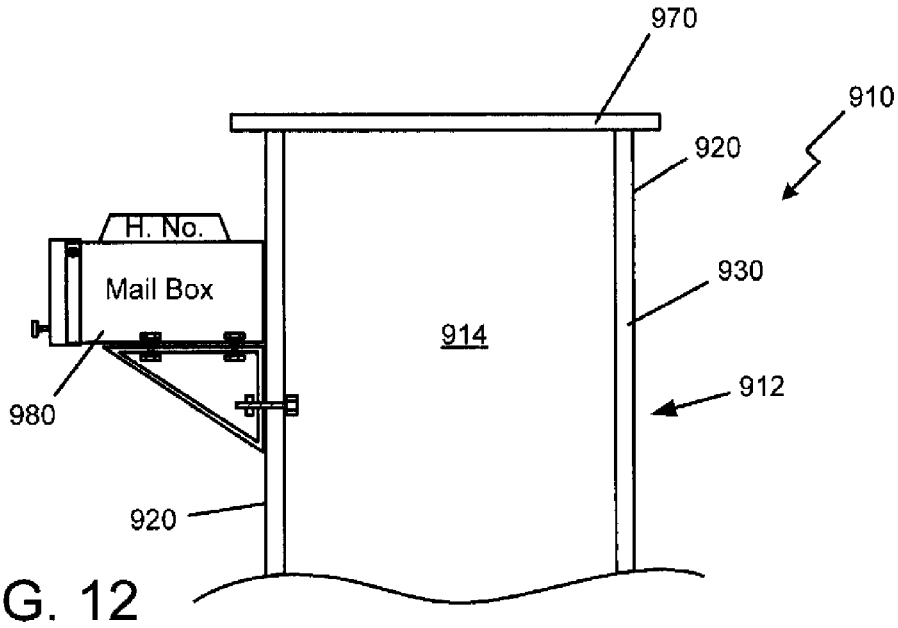
FIG. 12 is a cross-sectional view illustration of a fabricated stone apparatus, in accordance with a tenth exemplary embodiment of the present disclosure.

FIG. 12 is a cross-sectional view illustration of a fabricated stone apparatus 910, in accordance with a tenth exemplary embodiment of the present disclosure. The tenth exemplary embodiment of the disclosure may include any of the structures, components, features, or functions disclosed with respect to any of the other embodiments of this disclosure. The fabricated stone apparatus 910, which may be referred to as 'apparatus 910' includes a plurality of stone sheets 920 affixed together to form a fabricated stone structure 912 having a substantially hollow interior portion 914, wherein each of the plurality of stone sheets 920 is substantially planar, and wherein a side edge 930 on one of the plurality of stone sheets 920 engages with a side edge on another of the plurality of stone sheets 920. A cover plate 970 positioned at an end of the fabricated stone structure 912, wherein the cover plate 970 is connected to a top edge of at least a portion of the plurality of stone sheets 920, wherein the top edge is positioned substantially perpendicular to at least one of the side edges 930. At least one fastener (not shown) is connected between at least two of the plurality of stone sheets 920. A fixture 980, such as a mail box, may be mounted to the side of the apparatus 910 along one or more of the stone sheets 920. Various types of bracketing and fasteners, such as threaded connectors and nuts, may be used to secure the fixture 980 to the apparatus 910, all of which are within the scope of this disclosure.

Figure 13:
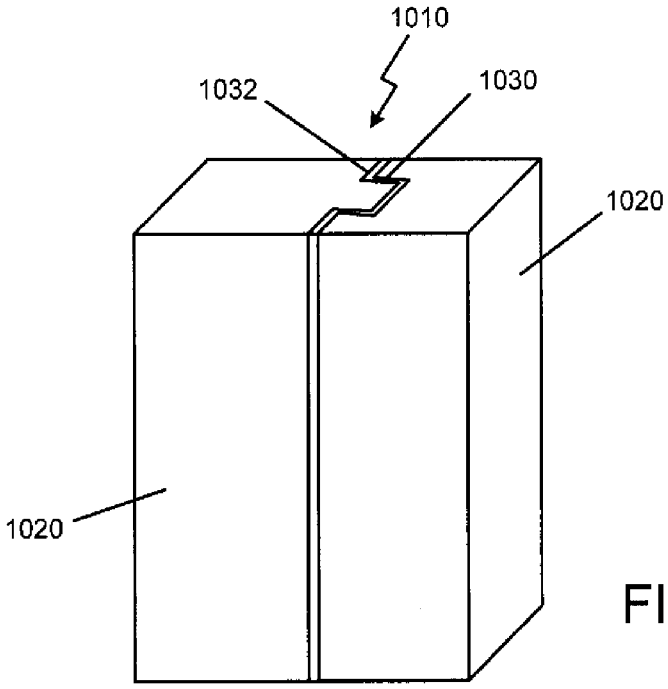
FIG. 13 is a plan view illustration of a fabricated stone apparatus, in accordance with an eleventh exemplary embodiment of the present disclosure.
Figure 14:
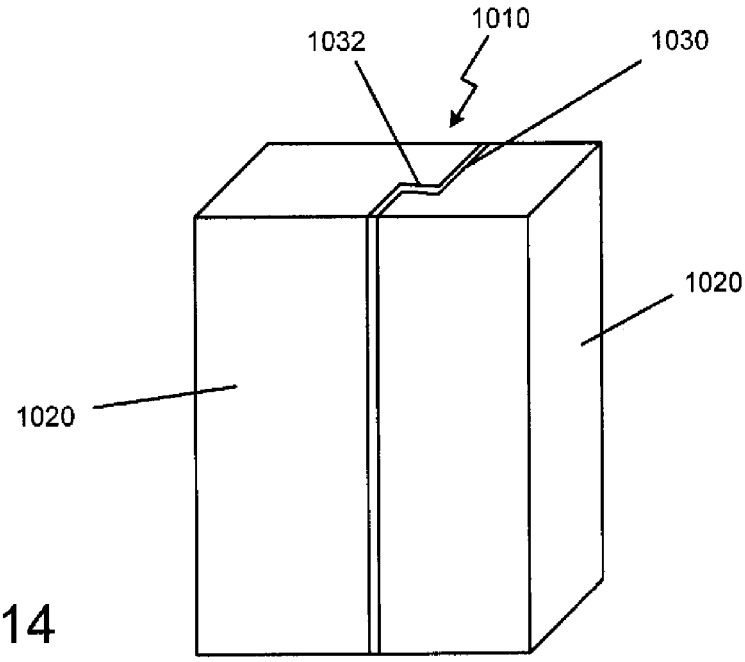
FIG. 14 is a plan view illustration of a fabricated stone apparatus, in accordance with the eleventh exemplary embodiment of the present disclosure.

FIG. 13 is a plan view illustration of a fabricated stone apparatus 1010, and FIG. 14 is a plan view illustration of a fabricated stone apparatus 1010, in accordance with an eleventh exemplary embodiment of the present disclosure. The eleventh exemplary embodiment of the disclosure may include any of the structures, components, features, or functions disclosed with respect to any of the other embodiments of this disclosure. The fabricated stone apparatus 1010, which may be referred to as 'apparatus 1010' may be a wall structure formed from one or more stone sheets 1020 that are engaged together at their edges 1030, 1032 in a vertical fashion, i.e., so each of the stone sheets 1020 is positioned next to another one. The side edges 1030, 1032 of the stone sheets 1020 may be designed to engage with each other to provide for a snug fit between the stone sheets 1020. The gap between the side edges 1030, 1032 may be very small, such as when the stone sheets 1020 are fully abutting, or the gap may contain an adhesive compound or other compound. Also, an adhesive compound may be used in the gap with just a flat, non-grooved abutment between the stone sheets 1020. The compounds may be used to secure the stone sheets 1020 together or mask the gap, thereby making the gap substantially indistinguishable. The engagement between the side edges 1030, 1032, may include a variety of different type of designs, such as a tongue and groove engagement, as is shown in FIG. 13, a step joint engagement, as is shown in FIG. 14, or any other type of engagement.

Figure 15:
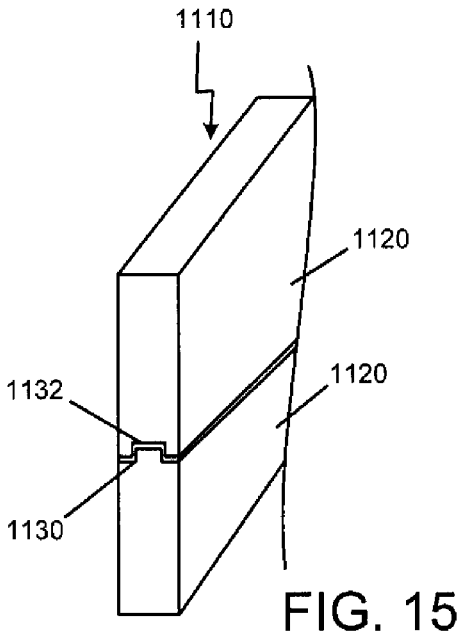
FIGS. 15-18 are plan view illustrations of a fabricated stone apparatus, in accordance with a twelfth exemplary embodiment of the present disclosure.
Figure 16:
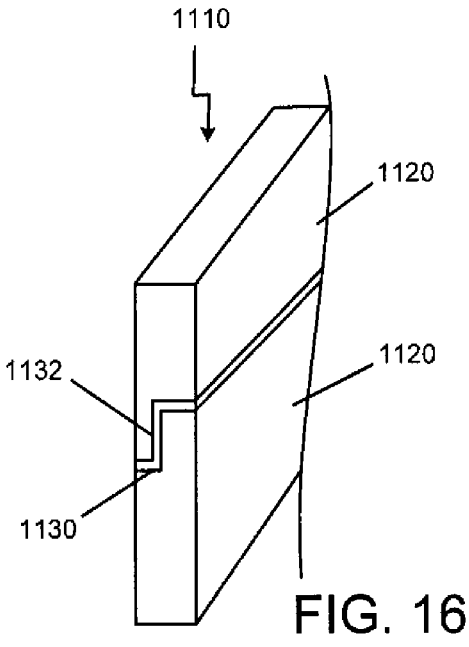

FIGS. 15-18 are plan view illustrations of a fabricated stone apparatus 1110, in accordance with a twelfth exemplary embodiment of the present disclosure. The twelfth exemplary embodiment of the disclosure may include any of the structures, components, features, or functions disclosed with respect to any of the other embodiments of this disclosure. The fabricated stone apparatus 1110, which may be referred to as 'apparatus 1110' may be a wall structure formed from one or more stone sheets 1120 that are engaged together at their side edges 1130, 1132 in a horizontal fashion, i.e., so each of the stone sheets 1120 is positioned above or below another one. The side edges 1130, 1132 of the stone sheets 1120 may be designed to engage with each other to provide for a snug fit between the stone sheets 1120. The gap between the side edges 1130, 1132 may be very small, such as when the stone sheets 1120 are fully abutting, or the gap may contain an adhesive compound or other compound. The compounds may be used to secure the stone sheets 1120 together or mask the gap, thereby making the gap substantially indistinguishable. The engagement between the side edges 1130, 1132, may include a variety of different type of designs, such as a tongue and groove engagement, as is shown in FIG. 15, or a step joint engagement, as is shown in FIG. 16.

Figure 17:
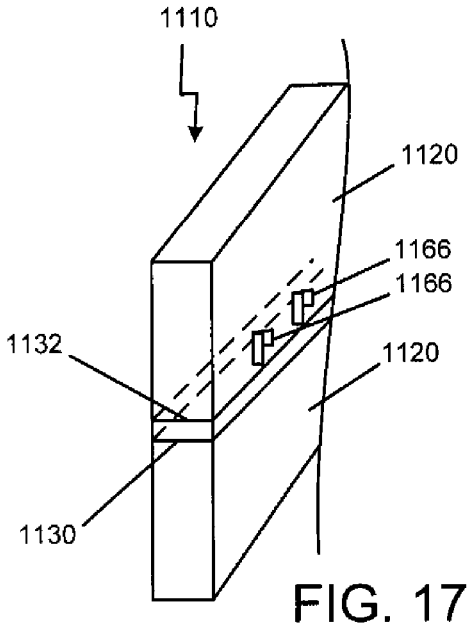
Figure 18:
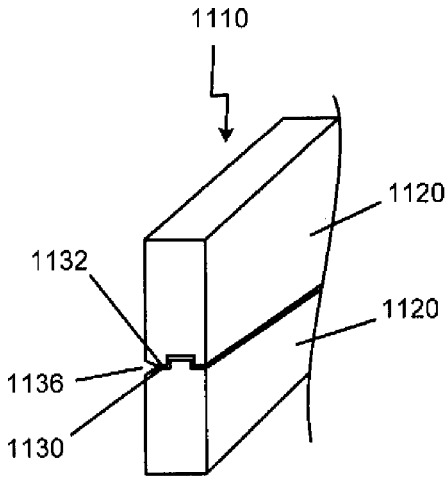

The apparatus 1110 may also include the use of a pin and slot system 1166, as is shown in FIG. 17. The pin and slot system 1166 may include any number of pins aligned to be received in one or more corresponding slots within the stone sheets 1120. Once the stone sheets 1120 are engaged together with the pin and slot system 1166, the stone sheets 1120 may be prevented from being moved in a lateral direction, thereby allowing the engaged stone sheets 1120 to effectively act as a unitary structure. A variety of aesthetic designs may be used with the apparatus 1110, including beveled or chamfered edges 1136, as is shown in FIG. 18. The beveled or chamfered edges 1136 may allow for one to visually distinguish between the individual stone sheets 1120 used, which may provide for enhanced aesthetic qualities of the apparatus 1110. Any other type of textural or visual components may be used with the apparatus 1110, such as textured surfaces on the stone sheets 1120, or different colors of stone sheets 1120, all of which are considered within the scope of the present disclosure.

Figure 19:
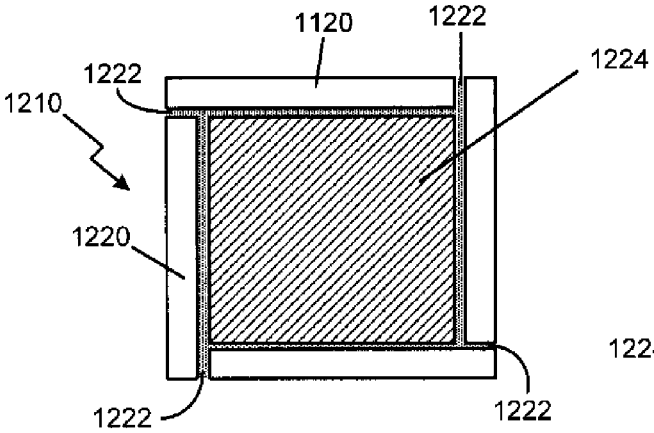
FIGS. 19-22 are top view cross-sectional illustrations of a fabricated stone apparatus, in accordance with a thirteenth exemplary embodiment of the present disclosure.

FIGS. 19-22 are top view cross-sectional illustrations of a fabricated stone apparatus 1210, in accordance with a thirteenth exemplary embodiment of the present disclosure. The thirteenth exemplary embodiment of the disclosure may include any of the structures, components, features, or functions disclosed with respect to any of the other embodiments of this disclosure. The fabricated stone apparatus 1210, which may be referred to as 'apparatus 1210' may be a structure formed from at least three stone sheets 1220 that are bonded together. In FIG. 19, the apparatus 1210 is shown with four stone sheets 1220 bonded together with adhesive joints 1222 and positioned around an interior structure 1224, such as a wooden post or PVC member. As can be seen, the stone sheets 1220 are all the same size and each one is bonded to another stone sheet 1220. Specifically, a portion of the elongated side of one stone sheet 1220 may be bonded to the face of another stone sheet 1220. The stone sheets 1220 may or may not be bonded to the interior structure 1224, depending on the design.

Figure 20:
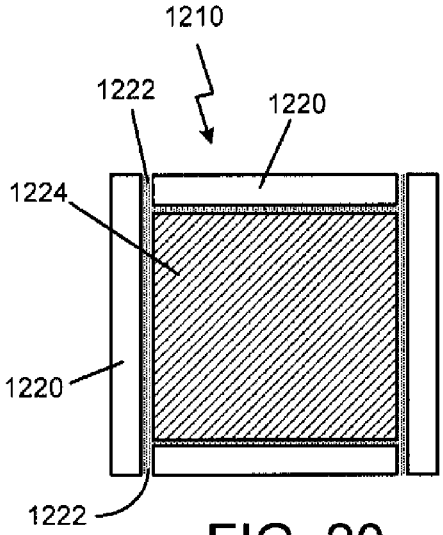
Figure 21:
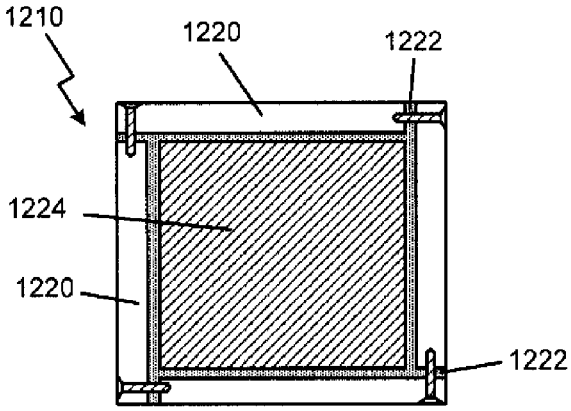
Figure 22:
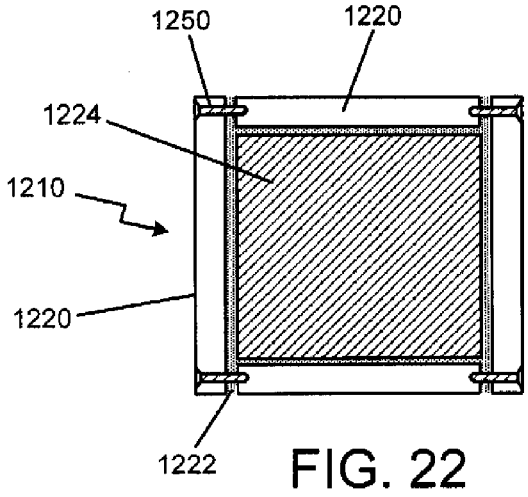

FIGS. 20-22 depict similar designs to that of FIG. 19. Specifically, FIG. 20 depicts the apparatus 1210 with stone sheets 1220 as different sizes and bonded to each other in different ways. For example, two stone sheets 1220 are short and two are long, wherein the four stone sheets 1220 are constructed in a square shape with the two faces of each of the two short stone sheets 1220 are bonded to the sides of the long stone sheets 1220. FIG. 21 depicts the apparatus 1210 shown in FIG. 19 but with threaded fasteners 1250 used to retain the stone sheets 1220 in addition to the adhesive compound. FIG. 22 depicts the apparatus 1210 shown in FIG. 20 but with threaded fasteners 1250 used to retain the stone sheets 1220 in addition to the adhesive compound.

Figure 23:
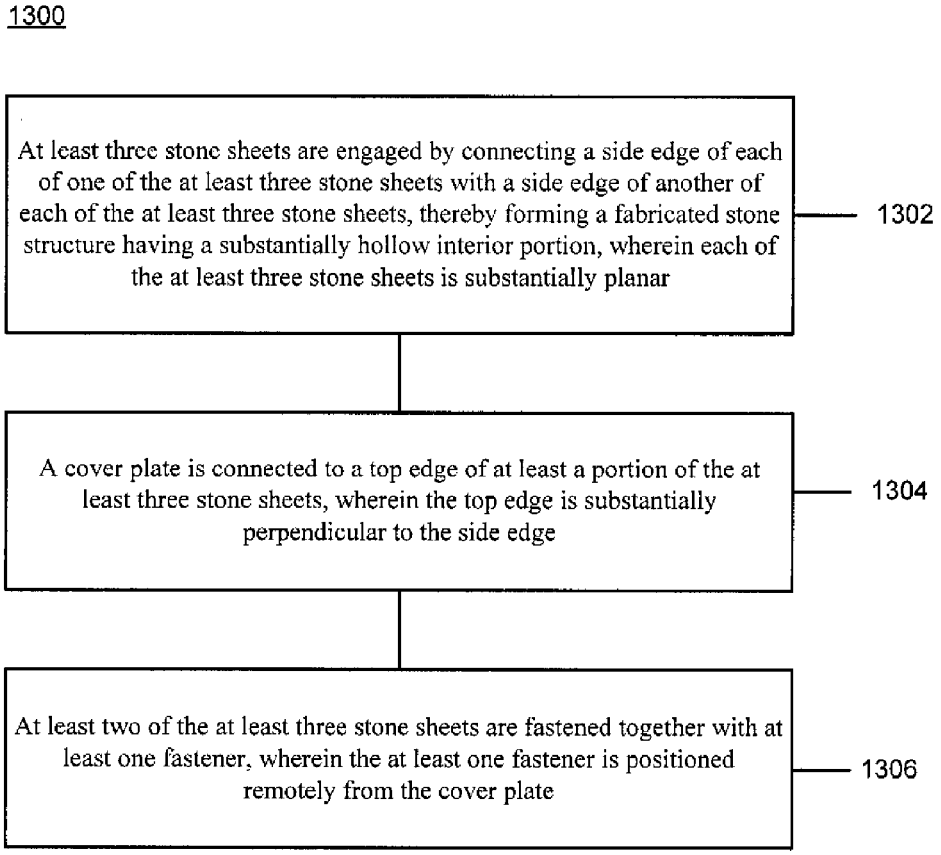
FIG. 23 is a flowchart illustrating a method for manufacturing a fabricated stone apparatus, in accordance with the first exemplary embodiment of the disclosure.

FIG. 23 is a flowchart 1300 illustrating a method for manufacturing a fabricated stone apparatus 10 in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 1302, at least three stone sheets are engaged by connecting a side edge of each of one of the at least three stone sheets with a side edge of another of each of the at least three stone sheets, thereby forming a fabricated stone structure having a substantially hollow interior portion, wherein each of the at least three stone sheets is substantially planar. A cover plate is connected to a top edge of at least a portion of the at least three stone sheets, wherein the top edge is substantially perpendicular to the side edge (block 1304). At least two of the at least three stone sheets are fastened together with at least one fastener, wherein the at least one fastener is positioned remotely from the cover plate (block 1306). Any number of additional steps, processes, functions, or structures may be included within the method, including anything disclosed relative to any embodiment of this disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A fabricated stone apparatus comprising:

a plurality of stone sheets affixed together to form a fabricated stone structure having a substantially hollow interior portion, wherein each of the plurality of stone sheets is substantially planar, and wherein a side edge of one of the plurality of stone sheets engages with a side edge of another of the plurality of stone sheets, wherein the engagement between the side edge of one of the plurality of stone sheets and the side edge of another of the plurality of stone sheets further comprises a grooved engagement;

a cover plate positioned at an end of the fabricated stone structure, wherein the cover plate is connected to a top edge of at least a portion of the plurality of stone sheets, wherein the top edge is positioned substantially perpendicular to at least one of the side edges; and at least one fastener connected between at least two of the plurality of stone sheets, wherein the at least one fastener is positioned remotely from the cover plate.

2. The fabricated stone apparatus of claim 1, wherein the cover plate is constructed from stone.

3. The fabricated stone apparatus of claim 1, wherein the grooved engagement further comprises at least one of: a tongue and groove engagement; a pin and slot engagement; and a step joint engagement.

4. The fabricated stone apparatus of claim 1, wherein the at least one fastener further comprises at least one threaded fastener.

5. The fabricated stone apparatus of claim 1, wherein non-abutting stone sheets are connected with at least one fastener.

6. The fabricated stone apparatus of claim 1, further comprising a reinforcing support column positioned within the substantially hollow interior portion of the fabricated stone structure.

7. A fabricated stone apparatus comprising:

a plurality of stone sheets affixed together to form a fabricated stone structure having a substantially hollow interior portion, wherein each of the plurality of stone sheets is substantially planar, and wherein a side edge of one of the plurality of stone sheets engages with a side edge of another of the plurality of stone sheets;

a cover plate positioned at an end of the fabricated stone structure, wherein the cover plate is connected to a top edge of at least a portion of the plurality of stone sheets, wherein the top edge is positioned substantially perpendicular to at least one of the side edges, further comprising at least one set of aligned holes positioned within the cover and within at least one stone sheet, wherein a pin is positioned within the set of aligned holes; and at least one fastener connected between at least two of the plurality of stone sheets, wherein the at least one fastener is positioned remotely from the cover plate.

8. A fixture-supporting, fabricated stone post apparatus comprising:

a plurality of stone sheets affixed together to form a fabricated stone structure having a substantially hollow interior portion, wherein each of the plurality of stone sheets is substantially planar, and wherein a side edge of one of the plurality of stone sheets engages with a side edge of another of the plurality of stone sheets, wherein a lower end of the fabricated stone structure is positioned below a ground surface, wherein the engagement between the side edge of one of the plurality of stone sheets and the side edge of another of the plurality of stone sheets further comprises a grooved engagement;

a cover plate positioned at an upper end of the fabricated stone structure, wherein the cover plate is connected to a top edge of at least a portion of the plurality of stone sheets, wherein the top edge is positioned substantially perpendicular to at least one of the side edges; and at least one fastener connected between at least two opposing stone sheets, wherein the at least one fastener is located in a position below the ground surface.

9. The fixture-supporting, fabricated stone post apparatus of claim 8, further comprising a fixture securely attached to at least one of the fabricated stone structure and the cover plate.

* * * * *